US008956104B2

(12) United States Patent
Lacy et al.

(10) Patent No.: US 8,956,104 B2
(45) Date of Patent: Feb. 17, 2015

(54) BUCKET ASSEMBLY FOR TURBINE SYSTEM

(75) Inventors: Benjamin Paul Lacy, Greer, SC (US); Anthony Louis Giglio, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 542 days.

(21) Appl. No.: 13/271,751

(22) Filed: Oct. 12, 2011

(65) Prior Publication Data

US 2013/0094944 A1 Apr. 18, 2013

(51) Int. Cl.

*F01D 5/08* (2006.01)
*F01D 11/08* (2006.01)
*F01D 5/22* (2006.01)

(52) U.S. Cl.

CPC ..... *F01D 5/225* (2013.01); *F05D 2250/294* (2013.01); *F05D 2260/204* (2013.01); *F05D 2230/31* (2013.01)
USPC ..... 415/115; 415/173.1; 416/97 R

(58) Field of Classification Search

CPC ..... F01D 5/182; F05D 2260/20; F05D 2260/202; F05D 2260/203; F05D 2260/204
USPC ..... 416/192, 95; 415/173.6
See application file for complete search history.

(56) References Cited

U.S. PATENT DOCUMENTS

| | | | |
|---|---|---|---|
| 4,118,146 | A | 10/1978 | Dierberger |
| 4,311,433 | A | 1/1982 | Bratton et al. |
| 5,626,462 | A | 5/1997 | Jackson et al. |
| 5,640,767 | A | 6/1997 | Jackson et al. |
| 6,190,129 | B1 | 2/2001 | Mayer et al. |
| 6,461,107 | B1 | 10/2002 | Lee et al. |
| 6,461,108 | B1 | 10/2002 | Lee et al. |
| 6,499,949 | B2 | 12/2002 | Schafrik et al. |
| 6,528,118 | B2 | 3/2003 | Lee et al. |
| 6,551,061 | B2 | 4/2003 | Darolia et al. |
| 6,582,194 | B1 | 6/2003 | Birkner et al. |
| 6,617,003 | B1 * | 9/2003 | Lee et al. ..... 428/131 |
| 6,627,323 | B2 * | 9/2003 | Nagaraj et al. ..... 428/469 |
| 6,761,534 | B1 * | 7/2004 | Willett ..... 416/97 R |
| 6,905,302 | B2 | 6/2005 | Lee et al. |
| 7,041,154 | B2 | 5/2006 | Staroselsky et al. |
| 7,465,335 | B2 | 12/2008 | Schmidt |
| 7,487,641 | B2 | 2/2009 | Frechette et al. |
| 2002/0106457 | A1 | 8/2002 | Lee et al. |
| 2002/0141869 | A1 | 10/2002 | Lee et al. |

(Continued)

FOREIGN PATENT DOCUMENTS

| | | | |
|---|---|---|---|
| DE | 19904229 | A1 * | 8/2000 |
| WO | 9841668 | A1 | 9/1998 |

OTHER PUBLICATIONS

Co-pending and commonly assignes U.S. Appl. No. 12/765,372, filed Apr. 22, 2010.

(Continued)

*Primary Examiner* — Nathaniel Wiehe
*Assistant Examiner* — Michael Sehn
(74) *Attorney, Agent, or Firm* — Dority & Manning, P.A.

(57) ABSTRACT

A bucket assembly is disclosed. The bucket assembly includes an airfoil having a generally aerodynamic contour and defining a tip, and a lower body portion extending generally radially inward from the airfoil. The bucket assembly further includes a tip shroud disposed on the tip of the airfoil and comprising a main body and a rail. The rail includes an exterior surface. The exterior surface defines a microchannel. The bucket assembly further includes a cover layer configured on the exterior surface.

20 Claims, 7 Drawing Sheets

(56) References Cited

U.S. PATENT DOCUMENTS

| | | | | |
|---|---|---|---|---|
| 2003/0209589 | A1 | 11/2003 | Hasz et al. | |
| 2005/0232771 | A1 * | 10/2005 | Harvey et al. | 416/97 R |
| 2008/0298975 | A1 | 12/2008 | James et al. | |
| 2009/0180896 | A1 * | 7/2009 | Brittingham | 416/97 R |
| 2010/0183427 | A1 | 7/2010 | Liang | |

OTHER PUBLICATIONS

Co-pending and commonly assigned U.S. Appl. No. 12/855,153, filed Aug. 12, 2010

Search Report and Written Opinion from EP Application No. 12187839.1 dated Jan. 28, 2013.

* cited by examiner

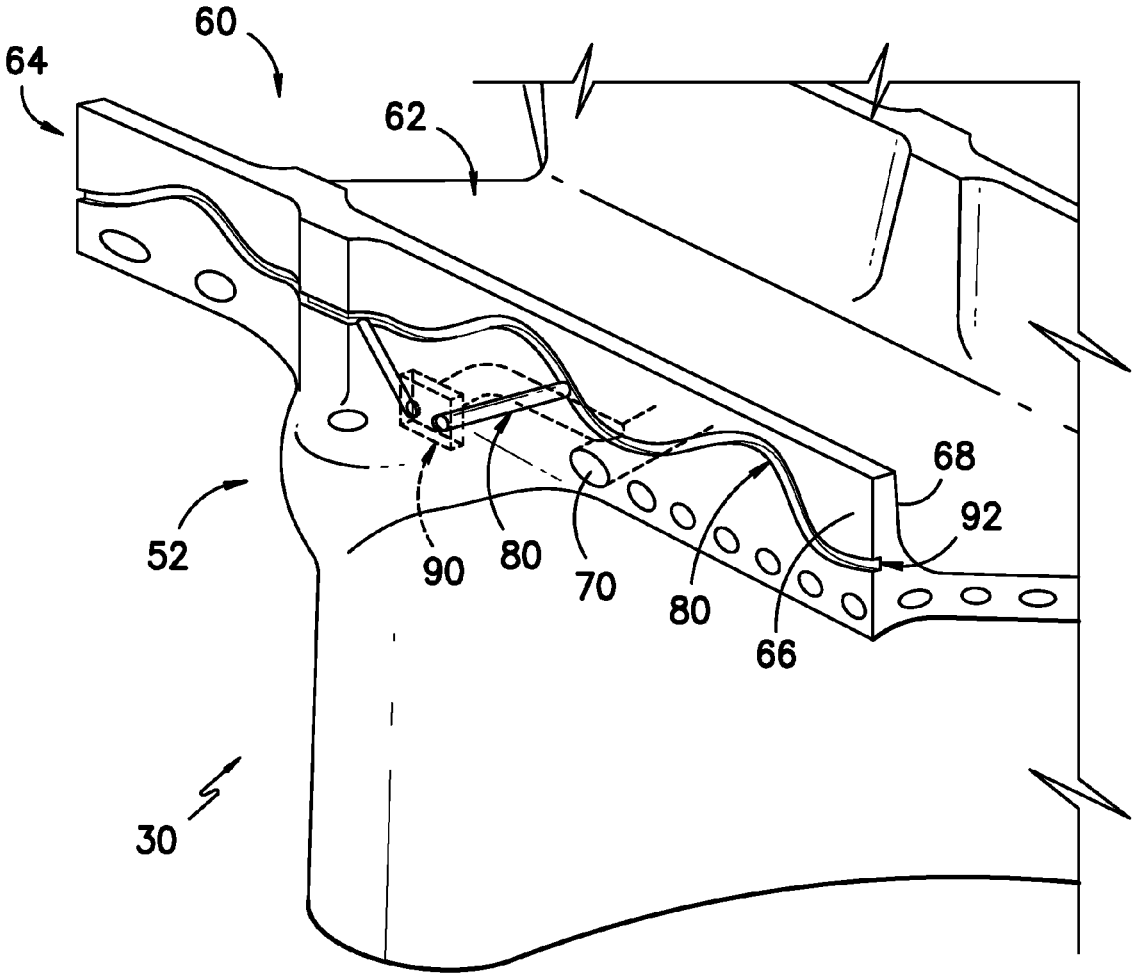
FIG. –5–

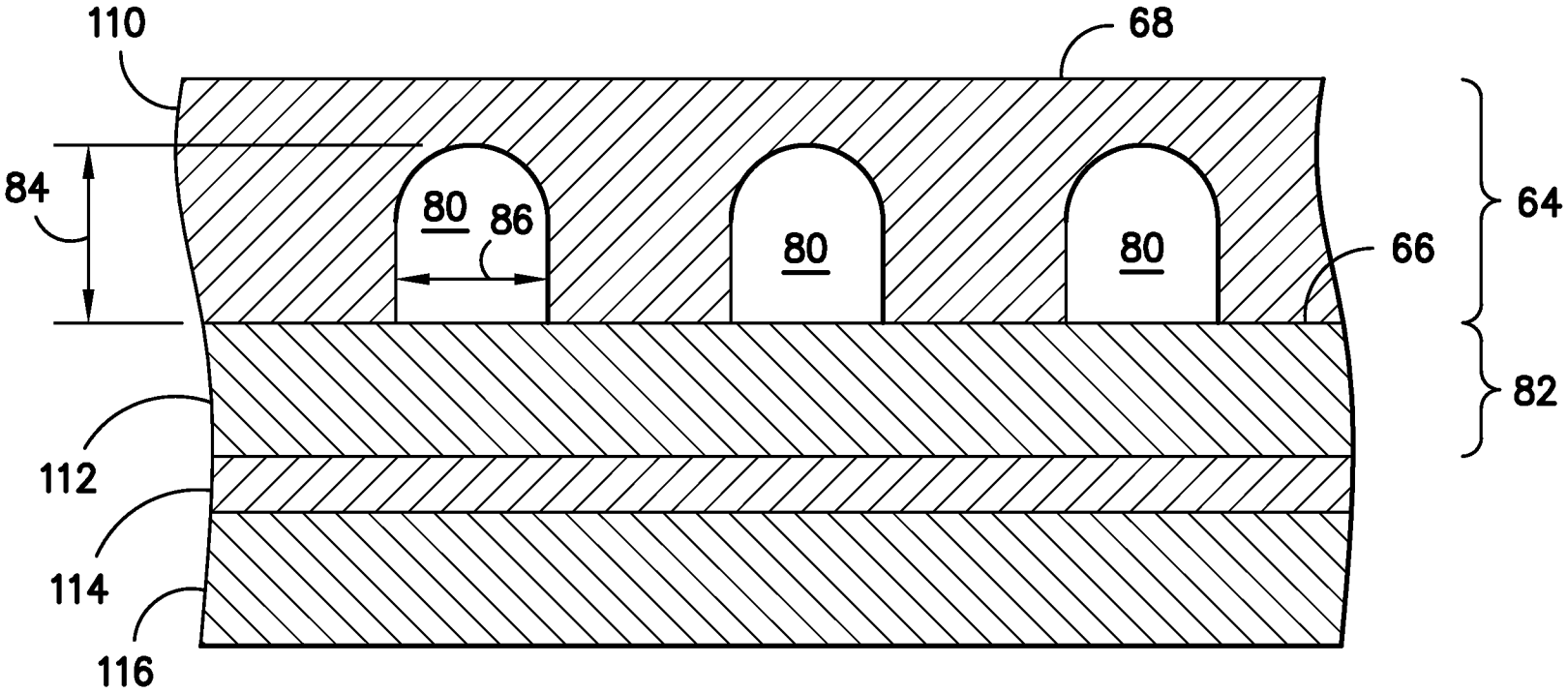
FIG. —6—

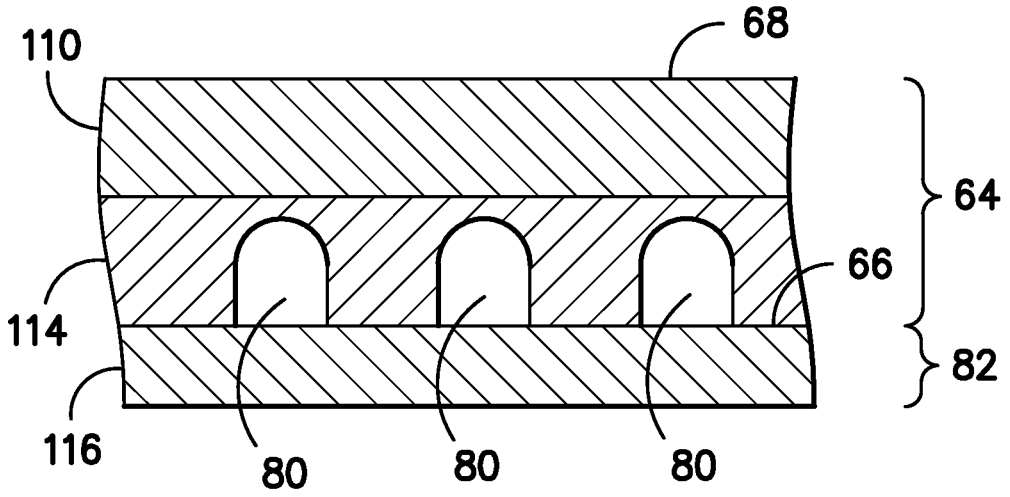
FIG. –7–
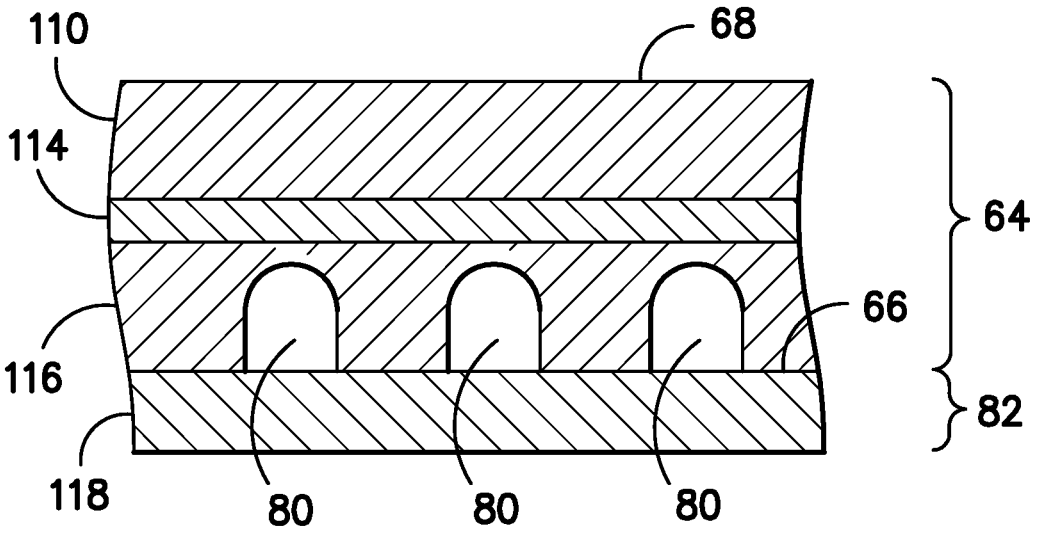
FIG. –8–

BUCKET ASSEMBLY FOR TURBINE SYSTEM

FIELD OF THE INVENTION

The subject matter disclosed herein relates generally to turbine systems, and more specifically to bucket assemblies for turbine systems.

BACKGROUND OF THE INVENTION

Turbine systems are widely utilized in fields such as power generation. For example, a conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

Various strategies are known in the art for cooling various gas turbine system components. For example, a cooling medium may be routed from the compressor and provided to various components. In the compressor and turbine sections of the system, the cooling medium may be utilized to cool various compressor and turbine components.

Buckets are one example of a hot gas path component that must be cooled. For example, various parts of the bucket, such as the airfoil, the platform, the shank, and the dovetail, are disposed in a hot gas path and exposed to relatively high temperatures and thus require cooling. Various cooling passages and cooling circuits may be defined in the various pans of the bucket, and cooling medium may be flowed through the various cooling passages and cooling circuits to cool the bucket.

One specific part of a bucket that requires cooling is the tip shroud. Tip shrouds are located on the tips of bucket airfoils and engage adjacent shroud blocks to provide a seal for the hot gas path. A typical tip shroud includes one or more rails that intersect with mating portions of the shroud blocks. Known designs of tip shrouds, however, do not include adequate cooling apparatus for cooling these rails. For example, typical tip shrouds do not provide cooling passages in the rails for cooling them.

Thus, an improved bucket assembly for a turbine system would be desired in the art. In particular, a bucket assembly that includes improved cooling apparatus for cooling a tip shroud would be advantageous.

BRIEF DESCRIPTION OF THE INVENTION

Aspects and advantages of the invention will be set forth in part in the following description, or may be obvious from the description, or may be learned through practice of the invention.

In one embodiment, a bucket assembly is disclosed. The bucket assembly includes an airfoil having a generally aerodynamic contour and defining a tip, and a lower body portion extending generally radially inward from the airfoil. The bucket assembly further includes a tip shroud disposed on the tip of the airfoil and comprising a main body and a rail. The rail includes an exterior surface. The exterior surface defines a microchannel. The bucket assembly further includes a cover layer configured on the exterior surface.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 5 is a close-up perspective view of a tip shroud of a bucket assembly according to another embodiment of the present disclosure;

FIG. 6 is a cross-sectional view of a tip shroud rail according to one embodiment of the present disclosure;

FIG. 7 is a cross-sectional view of a tip shroud rail according to another embodiment of the present disclosure; and, FIG. 8 is a cross-sectional view of a tip shroud rail according to another embodiment of the present disclosure.

DETAILED DESCRIPTION OF THE INVENTION

Figure 1:
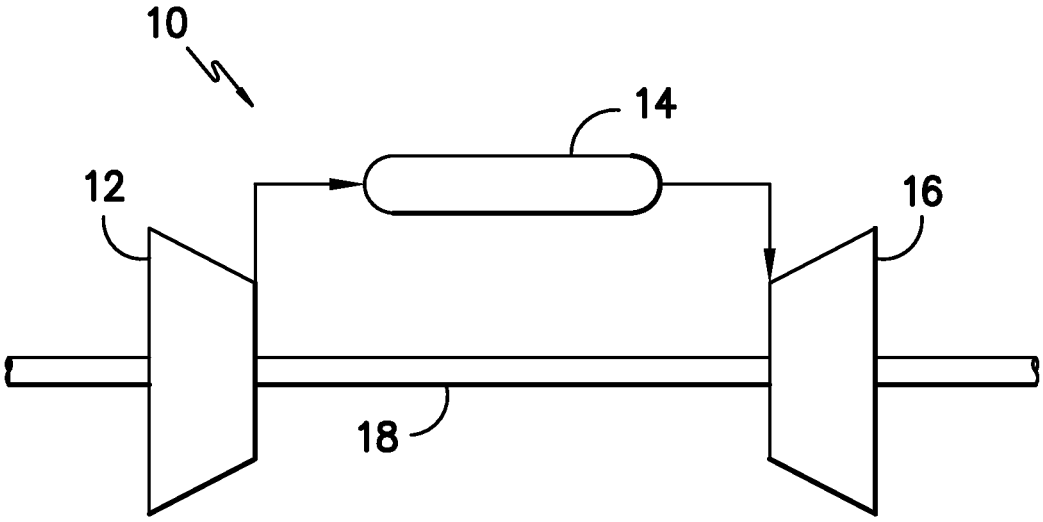
FIG. 1 is a schematic illustration of a gas turbine system according to one embodiment of the present disclosure.
Figure 2:
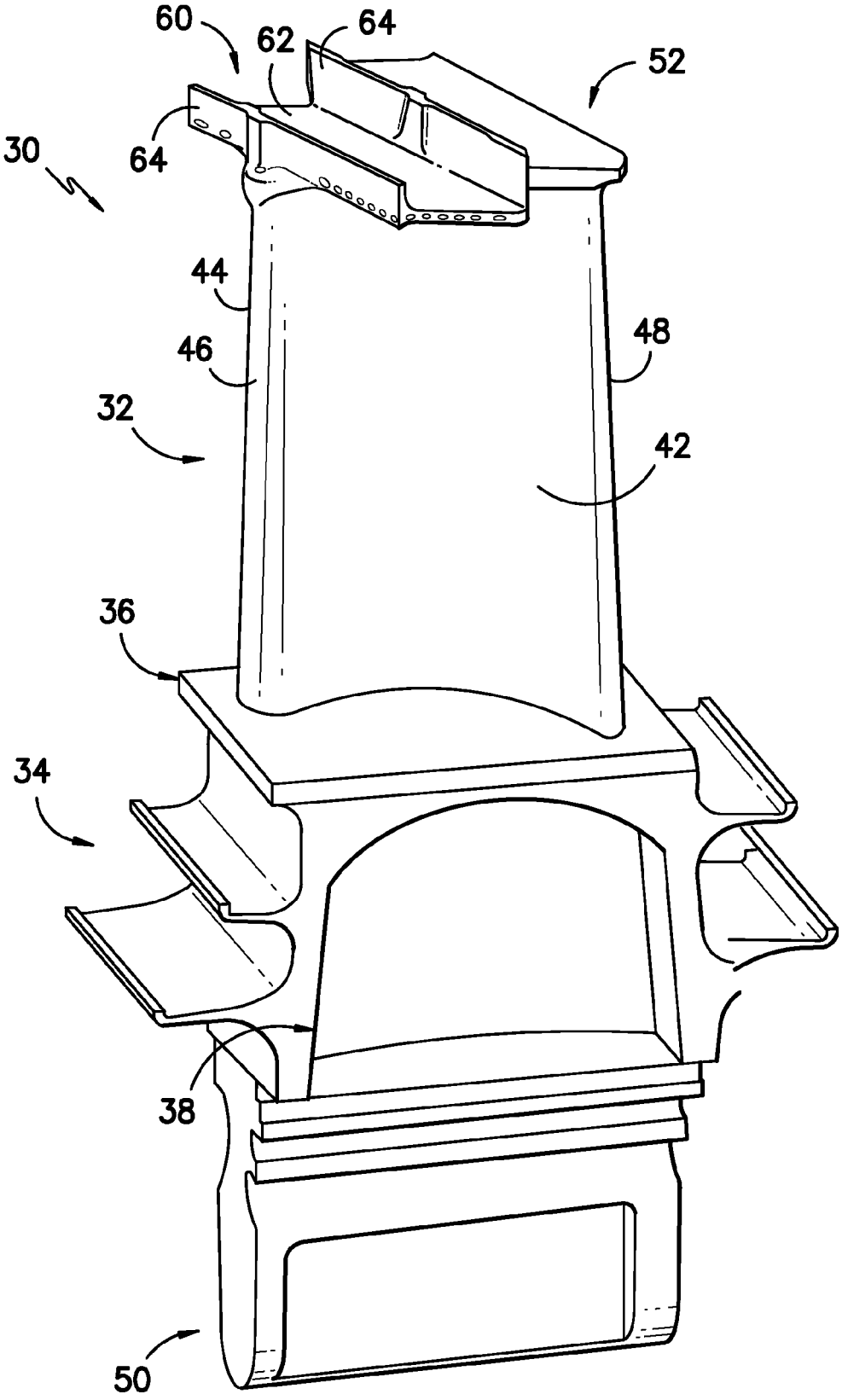
FIG. 2 is a perspective view of a bucket assembly according to one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, and a turbine 16. The compressor 12 and turbine 16 may be coupled by a shaft 18. The shaft 18 may be a single shaft or a plurality of shaft segments coupled together to form shaft 18.

The turbine 16 may include a plurality of turbine stages. For example, in one embodiment, the turbine 16 may have three stages. A first stage of the turbine 16 may include a plurality of circumferentially spaced nozzles and buckets. The nozzles may be disposed and fixed circumferentially about the shaft 18. The buckets may be disposed circumferentially about the shaft and coupled to the shaft 18. A second stage of the turbine 16 may include a plurality of circumferentially spaced nozzles and buckets. The nozzles may be disposed and fixed circumferentially about the shaft 18. The buckets may be disposed circumferentially about the shaft 18 and coupled to the shaft 18. A third stage of the turbine 16 may include a plurality of circumferentially spaced nozzles and buckets. The nozzles may be disposed and fixed circumferentially about the shaft 18. The buckets may be disposed circumferentially about the shaft 18 and coupled to the shaft 18. The various stages of the turbine 16 may be at least partially disposed in the turbine 16 in, and may at least partially define, a hot gas path 20. It should be understood that the turbine 16 is not limited to three stages, but rather that any number of stages are within the scope and spirit of the present disclosure.

Similarly, the compressor 12 may include a plurality of compressor stages (not shown). Each of the compressor 12 stages may include a plurality of circumferentially spaced nozzles and buckets.

One or more of the buckets in the turbine 16 and/or the compressor 12 may comprise a bucket assembly 30, as shown in FIGS. 2 through 5. The bucket assembly 30 may include an airfoil 32 and a lower body portion 34, which may include a platform 36 and shank 38. The airfoil 32 may have a generally aerodynamic contour. For example, the airfoil 32 may have exterior surfaces defining a pressure side 42 and suction side 44 each extending between a leading edge 46 and a trailing edge 48.

The lower body portion 34 may extend generally radially inward from the airfoil 32. A platform 36 may be positioned adjacent to the airfoil 32, and a shank 38 may be positioned radially inward of the platform 36.

The lower body portion 34 of the bucket assembly 30 may define a root 50. The root 50 may generally be the base portion of the bucket assembly 30. Further, the airfoil 32 may define a tip 52 of the bucket assembly 30. The tip 52 may generally be a radially outward-most portion of the airfoil 32 and/or the bucket assembly 30.

A bucket assembly 30 according to the present disclosure may further include a tip shroud 60. The tip shroud 60 may generally be disposed on the tip 52. For example, the tip shroud 60 may be integral with the airfoil 32 and located at the tip 52 of the airfoil 32, or the tip shroud 60 may be a separate component that is mounted to the airfoil at the tip 52.

A tip shroud 60 according to the present disclosure may engage adjacent shroud blocks (not shown) to provide a seal for the hot gas path 20. For example, a tip shroud 60 according to the present disclosure may include a main body 62. The main body 62 may contact the airfoil 32 at the tip 52. The tip shroud 60 may further include one or more rails 64, such as a leading edge rail 64 and a trailing edge rail 64 as shown. The rails 64 may extend generally radially outward from the main body 62, to intersect with mating portions of shroud blocks. Each rail 64 may further include an exterior surface 66 that faces outward towards the hot gas path 20 and an opposing interior surface 68, as shown.

Figure 3:
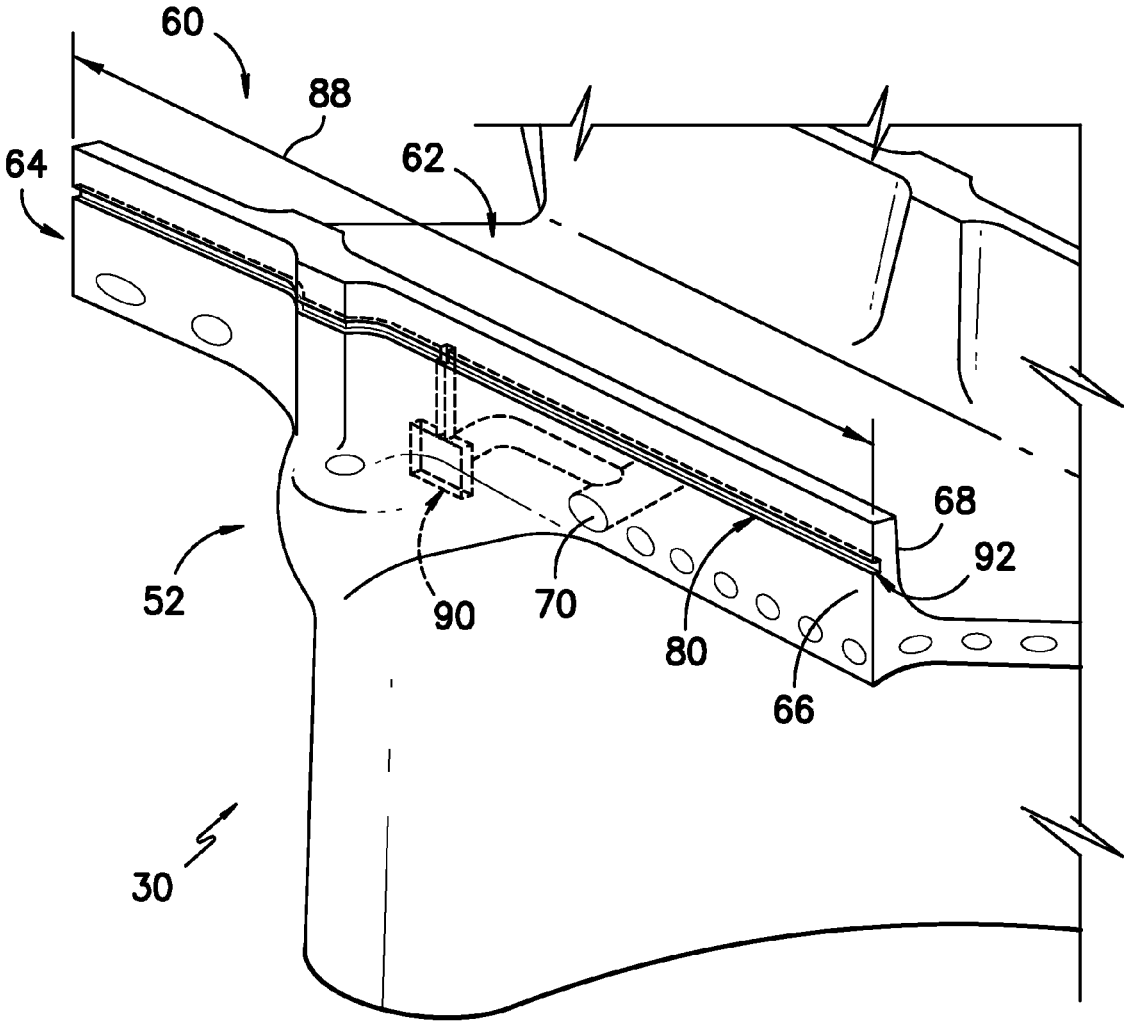
FIG. 3 is a close-up perspective view of a tip shroud of a bucket assembly according to one embodiment of the present disclosure.
Figure 4:
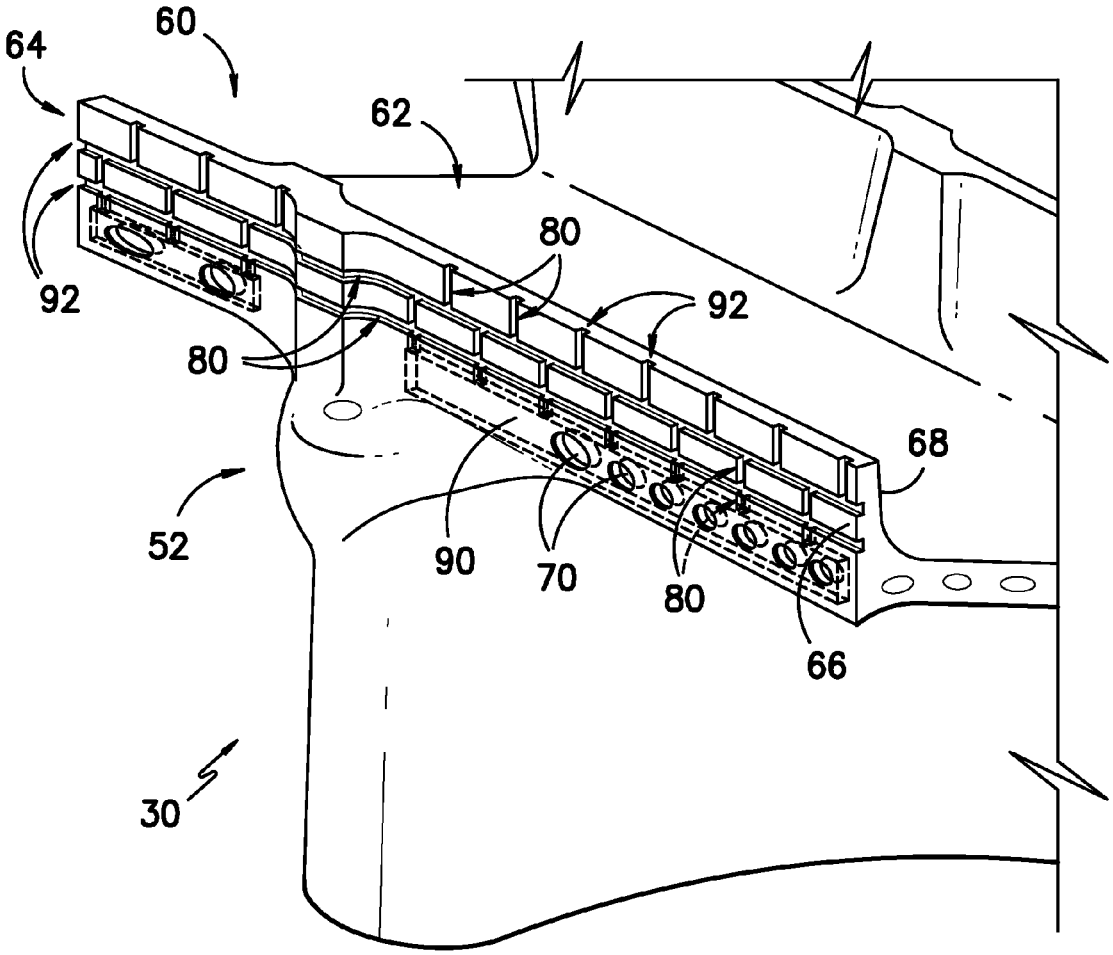
FIG. 4 is a close-up perspective view of a tip shroud of a bucket assembly according to another embodiment of the present disclosure.

Cooling passages may generally be defined in the bucket assembly 30. For example, cooling passages may be defined in the airfoil 32 and lower body portion 34. A cooling medium may be flowed into these cooling passages from, for example, inlets at the root 50 of the bucket assembly 30. The cooling medium may then be flowed through the cooling passages to cool various components of the bucket assembly 30. Further, as shown in FIGS. 3 through 5 for example, cooling passages 70 may be defined in the main body 62 of the tip shroud 60. These cooling passages 70 may be in fluid communication with other cooling passages in the bucket assembly 30, such that cooling medium may be flowed therethrough to cool the main body 62.

One or more rails 64 of a tip shroud 60 according to the present disclosure may further define one or more microchannels 80. For example, an exterior surface 66 or interior surface 68 of a rail 64 may define one or more microchannels 80. The microchannels 80 may be configured to flow cooling medium therethrough, to cool the rails 64, as discussed below. It should be understood that, while the microchannels 80 as shown are defined in a leading edge rail 64, such microchannels 80 may also be defined in a trailing edge rail 64 and/or any other suitable rail 64. The use of microchannels 80 to cool the rails 64 of a tip shroud 60 is particularly advantageous due to the small size of the microchannels 80, which allows them to be provided on relatively thin rails 64, as well as the beneficial cooling characteristics of the microchannels 80.

A bucket assembly 30 according to the present disclosure may further include a cover layer 82, as shown in FIGS. 6 through 8 (not shown in FIGS. 3 through 5 for illustrative purposes). The cover layer 82, as discussed below, may be configured on with the exterior surface 66 or interior surface 68 to cover the microchannel 80.

Microchannels 80 may be configured to flow cooling medium 64 therethrough, cooling the rails 64 and tip shroud 60 in general. For example, the microchannels 80 may generally be open channels formed and defined on the exterior surface 66 and/or interior surface 68 of a rail 64. Additionally, the cover layer 82 may cover, and in exemplary embodiments may further define, the microchannels 80. Cooling medium flowed to the microchannels 80, as discussed below, may flow through the microchannels 80 between the exterior surface 66 and/or interior surface 68 and the cover layer 82, cooling the rail 64 and tip shroud 60 in general, and may then be exhausted from the microchannels 80, as discussed below. The microchannels 80 may be formed through, for example, laser machining, water jet machining, electro-chemical machining ("ECM"), electro-discharge machining ("EDM"), photolithography, or any other process capable of providing suitable microchannels 80 with proper sizes and tolerances.

The microchannels 80 may have depths 84 in the range from approximately 0.2 millimeters ("mm") to approximately 3 mm, such as from approximately 0.5 mm to approximately 1 mm. Further, the microchannels 80 may have widths 86 in the range from approximately 0.2 mm to approximately 3 mm, such as from approximately 0.5 mm to approximately 1 mm. It should further be understood that the depths 84 and widths 86 of the microchannels 80 need not be identical for each microchannel 80, but may vary between microchannels 80.

Each microchannel 80 may further define a length 88. In an exemplary embodiment, the depth 84 of each of the plurality of microchannels 80 may be substantially constant throughout the length 88 of the microchannel 80. In another exemplary embodiment, however, the depth 84 of each of the plurality of microchannels 80 may be tapered. For example, the depth 84 of each of the plurality of microchannels 80 may be reduced through the length 88 of the microchannel 80 in the direction of flow of the cooling medium through the microchannel 80. Alternatively, however, the depth 84 of each of the plurality of microchannels 80 may be enlarged through the length 88 of the microchannel 80 in the direction of flow of the cooling medium through the microchannel 80. It should be understood that the depth 84 of each of the plurality of microchannels 80 may vary in any manner throughout the length 88 of the microchannel 80, being reduced and enlarged as desired. Further, it should be understood that various microchannels 80 may have substantially constant depths 84, while other microchannels 80 may have tapered depths 84.

In an exemplary embodiment, the width 86 of each of the plurality of microchannels 80 may be substantially constant throughout the length 88 of the microchannel 80. In another exemplary embodiment, however, the width 86 of each of the plurality of microchannels 80 may be tapered. For example, the width 86 of each of the plurality of microchannels 80 may be reduced through the length 88 of the microchannel 80 in the direction of flow of the cooling medium through the microchannel 80. Alternatively, the width 86 of each of the plurality of microchannels 80 may be enlarged through the length 88 of the microchannel 80 in the direction of flow of the cooling medium through the microchannel 80. It should be understood that the width 86 of each of the plurality of microchannels 80 may vary in any manner throughout the length 88 of the microchannel 80, being reduced and enlarged as desired. Further, it should be understood that various microchannels 80 may have substantially constant widths 86, while other microchannels 80 may have tapered widths 86.

The microchannels 80 may have cross-sections with any geometric shape, such as, for example, rectangular, oval, triangular, or having any other geometric shape suitable to facilitate the flow of cooling medium through the microchannel 80. It should be understood that various microchannels 80 may have cross-sections with certain geometric shapes, while other microchannels 80 may have cross-sections with other various geometric shapes. Microchannel 80 cross-sectional shape and size may be constant, or may vary along the length 88.

Each microchannel 80, or various portions thereof, may be linear or curvilinear. For example, in some embodiments, as shown in FIGS. 3 and 4, a microchannel 80 may be generally linear. In other embodiments, a microchannel 80 may be sinusoidal as shown in FIG. 5, or serpentine or otherwise curvilinear.

In exemplary embodiments, each of the plurality of microchannels 80 may have a substantially smooth surface. For example, the surface of the microchannels 80 may be substantially or entirely free of protrusions, recesses, or surface texture. In an alternative embodiment, however, each of the plurality of microchannels 80 may have a surface that includes one or more surface features. The surface features may be discrete protrusions extending from the surface of the microchannels 80. For example, the surface features may include fin-shaped protrusions, cylindrical-shaped protrusions, ring-shaped protrusions, chevron-shaped protrusions, raised portions between cross-hatched grooves formed within the microchannel 80, or any combination thereof, as well as any other suitable geometric shape. It should be understood that the dimensions of the surface features may be selected to optimize cooling of the rail 64 and tip shroud 60 in general while satisfying the geometric constraints of the microchannels 80.

In some embodiments, each of the microchannels 80 may be singular, discrete microchannels 80. In other embodiments, however, each of the microchannels 80, or any portion of the microchannels 80, may branch off from single microchannels 80 to form multiple microchannel branches. Further, in some embodiments as shown in FIGS. 4 and 5, at least a portion of the microchannels 80 may be in fluid communication with one another, such that cooling medium flows from one microchannel 80 to another in the rail 64.

To obtain cooling medium for flowing therethrough, one or more microchannels 80 may be in fluid communication with cooling passages defined in the bucket assembly 30. For example, in exemplary embodiments as shown in FIGS. 3 through 5, one or more microchannels 80 may be in fluid communication with cooling passages 70 defined in the main body 62 of the tip shroud 60. In other embodiments, one or more microchannels 80 may be in fluid communication with any other suitable cooling passages, such as for example cooling passages defined in the airfoil 32.

Further, in some embodiments as shown in FIGS. 3 through 5, a plenum 90 may be defined in the tip shroud 60 between a cooling passage, such as cooling passage 70, and a microchannel 80. The plenum 90 may accept cooling medium from the cooling passage and supply the cooling medium to the microchannel 80. The plenum may be defined in, for example, the main body 62 or a rail 64.

After being flowed through the microchannels 80, cooling medium may be exhausted from the microchannels 80. For example, in some embodiments, the cooling medium is exhausted through exhaust ports 92, which may be located on the top and/or sides of a rail 64 as shown.

The rail 64 and the cover layer 82 may each comprise a singular material, such as a substrate or a coating, or may each comprise a plurality of materials, such as a plurality of substrates and coatings. For example, in one exemplary embodiment as shown in FIG. 6, the rail 64 may comprise a tip shroud substrate 110. For example, the substrate 110 may be a nickel-, cobalt-, or iron-based superalloy. The alloys may be cast or wrought superalloys. It should be understood that the tip shroud substrate 110 of the present disclosure is not limited to the above materials, but may be any suitable material for any portion of a tip shroud 60 or bucket assembly 30 in general.

Further, as shown in FIG. 6, the cover layer 82 may comprise a metal coating 112. The coating 112 may be a cover layer or other suitable coating. In one exemplary aspect of an embodiment, the metal coating 112 may be any metal or metal alloy based coating, such as, for example, a nickel-, cobalt-, iron-, zinc-, or copper-based coating. The metal coating 112 may include one or more sheets, strips, or wires. The metal coating 112 may be attached through welding, brazing, or any other suitable coating or bonding technique or apparatus.

Alternatively, the cover layer 82 may comprise a bond coating 114. The bond coating 114 may be any appropriate bonding material. For example, the bond coating 114 may have the chemical composition MCrAl(X), where M is an element selected from the group consisting of Fe, Co and Ni and combinations thereof, and (X) is an element selected from the group consisting of gamma prime formers, solid solution strengtheners, consisting of, for example, Ta, Re and reactive elements, such as Y, Zr, Hf, Si, and grain boundary strengtheners consisting of B, C and combinations thereof. The bond coating 114 may be applied to the rail 64 through, for example, a physical vapor deposition process such as electron beam evaporation, ion-plasma arc evaporation, or sputtering, or a thermal spray process such as air plasma spray, high velocity oxy-fuel or low pressure plasma spray. Alternatively, the bond coating 114 may be a diffusion aluminide bond coating, such as a coating having the chemical composition NiAl or PtAl, and the bond coating 114 may be applied to the rail 64 through, for example, vapor phase aluminiding or chemical vapor deposition.

Alternatively, the cover layer 82 may comprise a thermal barrier coating ("TBC") 116. The TBC 116 may be any appropriate thermal barrier material. For example, the TBC 116 may be yttria-stabilized zirconia, and may be applied to the rail 64 through a physical vapor deposition process or thermal spray process. Alternatively, the TBC 116 may be a ceramic, such as, for example, a thin layer of zirconia modified by other refractory oxides such as oxides formed from Group IV, V and VI elements or oxides modified by Lanthanide series elements such as La, Nd, Gd, Yb and the like.

In other exemplary embodiments, as discussed above, the rail 64 and the cover layer 82 may each comprise a plurality of materials, such as a plurality of substrates and coatings. For example, in one embodiment as shown in FIG. 7, the rail 64 may comprise a tip shroud substrate 110 and a bond coating 114. The bond coating 114 may define the exterior surface 66 or interior surface 68. Thus, the plurality of microchannels 80 may be defined in the bond coating 114. Further, as shown in FIG. 7, the cover layer 82 may comprise a TBC 116.

In another embodiment as shown in FIG. 8, the rail 64 may comprise a tip shroud substrate 110, a bond coating 114, and a first TBC 116. The first TBC 116 may define the exterior surface 66 or interior surface 68. Thus, the plurality of microchannels 80 may be defined in the first TBC 116. Further, as shown in FIG. 8, the cover layer 82 may comprise a second TBC 118.

Additionally, as shown in FIG. 6, the bucket assembly 30 may include a TBC 116 disposed adjacent the cover layer 82. Further, as shown in FIG. 6, the bucket assembly 30 may include a bond coating 114 disposed between the TBC 116 and the cover layer 82. Alternatively, the cover layer 82 may include the metal coating 112, the bond coating 114, and the TBC 116.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A bucket assembly comprising:

an airfoil having a generally aerodynamic contour and defining a tip;

a lower body portion extending generally radially inward from the airfoil;

a tip shroud disposed on the tip of the airfoil and configured to provide a seal for a hot gas path, the tip shroud comprising a main body and a rail, the rail comprising an exterior surface, an opposing interior surface, and an outer surface connecting the exterior surface and interior surface, the exterior surface defining a microchannel; and a cover layer configured on the exterior surface.

2. The bucket assembly of claim 1, wherein the exterior surface defines a plurality of microchannels.

3. The bucket assembly of claim 2, wherein at least a portion of the plurality of microchannels are in fluid communication with each other.

4. The bucket assembly of claim 1, wherein the microchannel is in fluid communication with a cooling passage defined in the main body of the tip shroud.

5. The bucket assembly of claim 1, wherein a plenum is defined in the tip shroud between the cooling passage and the microchannel.

6. The bucket assembly of claim 1, wherein the cover layer is one of a metal coating, a bond coating, or a thermal barrier coating.

7. The bucket assembly of claim 1, further comprising a thermal barrier coating disposed adjacent the cover layer.

8. The bucket assembly of claim 7, further comprising a bond coating disposed between the thermal barrier coating and the cover layer.

9. The bucket assembly of claim 1, wherein the rail comprises a tip shroud substrate.

10. The bucket assembly of claim 1, wherein the rail comprises a tip shroud substrate and a bond coating, and wherein the microchannel is defined in the bond coating.

11. The bucket assembly of claim 10, wherein the cover layer comprises a thermal barrier coating.

12. The bucket assembly of claim 1, wherein the rail comprises a tip shroud substrate, a bond coating, and a first thermal barrier coating, and wherein the microchannel is defined in the first thermal barrier coating.

13. The bucket assembly of claim 12, wherein the cover layer comprises a second thermal barrier coating.

14. A turbine system comprising:

a compressor;

a turbine coupled to the compressor; and a plurality of bucket assemblies disposed in at least one of the compressor or the turbine, at least one of the bucket assemblies comprising:

an airfoil having a generally aerodynamic contour and defining a tip;

a lower body portion extending generally radially inward from the airfoil;

a tip shroud disposed on the tip of the airfoil and configured to provide a seal for a hot gas path, the tip shroud comprising a main body and a rail, the rail comprising an exterior surface, an opposing interior surface, and an outer surface connecting the exterior surface and interior surface, the exterior surface defining a microchannel; and a cover layer configured on the exterior surface.

15. The turbine system of claim 14, wherein the microchannel is in fluid communication with a cooling passage defined in the main body of the tip shroud.

16. The turbine system of claim 14, wherein the cover layer is one of a metal coating, a bond coating, or a thermal barrier coating.

17. The turbine system of claim 14, further comprising a thermal barrier coating disposed adjacent the cover layer.

18. The turbine system of claim 14, wherein the rail comprises a tip shroud substrate.

19. The turbine system of claim 14, wherein the rail comprises a tip shroud substrate and a bond coating, and wherein the microchannel is defined in the bond coating.

20. The turbine system of claim 14, wherein the rail comprises a tip shroud substrate, a bond coating, and a first thermal barrier coating, and wherein the microchannel is defined in the first thermal barrier coating.

* * * * *